US009554225B2

(12) United States Patent
Van Tol et al.

(10) Patent No.: US 9,554,225 B2
(45) **Date of Patent: *Jan. 24, 2017**

(54) DEVICES AND METHODS FOR AUDIBLE INDICATORS EMANATING FROM SELECTED LOCATIONS

(71) Applicant: COVIDIEN LP, Mansfield, MA (US)

(72) Inventors: David J. Van Tol, Boulder, CO (US); Anthony B. Ross, Boulder, CO (US)

(73) Assignee: COVIDIEN LP, Mansfield, MA (US)

( * ) Notice: Subject to any disclaimer, the term of this patent is extended or adjusted under 35 U.S.C. 154(b) by 116 days.

This patent is subject to a terminal disclaimer.

(21) Appl. No.: 14/335,414

(22) Filed: Jul. 18, 2014

(65) Prior Publication Data

US 2015/0092956 A1 Apr. 2, 2015

Related U.S. Application Data

(60) Provisional application No. 61/884,612, filed on Sep. 30, 2013, provisional application No. 61/884,603, filed on Sep. 30, 2013.

(51) Int. Cl.
*H04R 27/00* (2006.01)

(52) U.S. Cl.
CPC ..... *H04R 27/00* (2013.01); *H04R 2217/03* (2013.01)

(58) Field of Classification Search
CPC ..... H04R 27/00; H04R 2217/03
USPC ..... 381/77, 80, 92
See application file for complete search history.

(56) References Cited

U.S. PATENT DOCUMENTS

| | | | | |
|---|---|---|---|---|
| 6,580,374 | B2 * | 6/2003 | Schrage | G08G 1/0962 340/905 |
| 6,807,281 | B1 * | 10/2004 | Sasaki | H04R 1/403 381/111 |
| 8,027,488 | B2 * | 9/2011 | Pompei | G10K 15/02 367/137 |
| 2004/0264707 | A1 * | 12/2004 | Yang | G10K 15/02 381/77 |
| 2006/0287645 | A1 * | 12/2006 | Tashiro | A61B 17/00 606/1 |
| 2007/0211574 | A1 * | 9/2007 | Croft, III | G10K 15/02 367/197 |
| 2007/0286433 | A1 * | 12/2007 | Yoshino | H04S 7/302 381/82 |
| 2009/0173846 | A1 * | 7/2009 | Katz | F16M 11/04 248/124.1 |
| 2010/0092005 | A1 * | 4/2010 | Dunn | H04R 1/403 381/77 |

* cited by examiner

*Primary Examiner* — David Ton

(57) ABSTRACT

Methods, systems, and devices are described for providing audio to one or more individuals in an operating room. An ultrasonic signal generator may be provided that generates two or more ultrasonic signals that combine to produce an audible signal at a desired location. The audio signal may be perceived by individuals in the operating room to emanate from a surface or location within the operating room, or the audio signal may be generated to provide an audible signal to one or more persons within a particular location within the operating room. Multiple audio signals may be generated to emanate from multiple different locations. Likewise, multiple audio signals may be generated to provide different audible signals in different locations in the operating room.

18 Claims, 14 Drawing Sheets

DEVICES AND METHODS FOR AUDIBLE INDICATORS EMANATING FROM SELECTED LOCATIONS

CROSS-REFERENCE TO RELATED APPLICATIONS

This application claims the benefit of, and priority to, U.S. Provisional Patent Application Nos. 61/884,603 and 61/884,612, both of which were filed on Sep. 30, 2013. This application is related to U.S. patent application Ser. No. 14/335,508, filed on Jul. 18, 2014. The entire contents of each of the above applications are hereby incorporated herein by reference.

BACKGROUND

The following relates generally to systems, devices and related methods of receipt of audible information in an operating room. More specifically, the present disclosure relates to providing audio to one or more individuals in an operating room in which the sound is perceived to emanate from a particular location within the operating room.

In operating room environments different individuals are tasked with different responsibilities. For example, a surgeon and one or more assistants, such as a resident and/or a scrub nurse, may be responsible for performing a surgical procedure on a patient. Similarly, an anesthesiologist may be responsible for maintaining the proper state of anesthetic for the patient and monitoring various vital statistics of the patient. A circulating nurse may provide support to different individuals in the operating room. In each case, the particular individuals may monitor one or more pieces of support equipment and/or surgical equipment, and in many cases the support and/or surgical equipment may provide one or more audible indicators according to the particular state of the equipment or monitoring that the equipment performs. In many situations, multiple different pieces of equipment may provide audible indications, and individuals in the operating room may hear indications from not only the equipment that they are responsible for monitoring, but also other pieces of equipment. In order to facilitate efficient operations in such environments, it may be beneficial to have audio from various pieces of equipment focused at particular individuals.

SUMMARY

Various methods, systems, devices, and apparatuses are described for providing audio to one or more individuals in an operating room. An ultrasonic signal generator may be provided that provides two or more ultrasonic signals that combine to produce an audible signal at a desired location. The audio signal may be perceived by individuals in the operating room to emanate, for example, from a surface or location within the operating room, or the audio signal may be generated to provide an audible signal to one or more persons within a particular location within the operating room. Multiple audio signals may be generated to emanate from multiple different locations. Likewise, multiple audio signals may be generated to provide different audible signals in different locations in the operating room. Combinations may also be provided in some embodiments, in which an audio signal generator is configured to generate an audio signal that may be perceived to emanate from a first location and to generate another audio signal audible by persons within a particular location within the operating room.

According to an aspect of the disclosure, a method for providing audio to one or more individuals in an operating room is provided. The method generally includes identifying a first location within an operating room from which it is desired to have sound emanate, and configuring first and second ultrasonic signal generators at one or more locations in the operating room different than the first location to focus first and second ultrasonic signals to the first location, the first and second ultrasonic signals combining to generate an audio signal substantially at the first location of the operating room. The audio signal may, in some examples, be synchronized with one or more information source located in the operating room, such as a piece of medical equipment, a surgical device, and/or medical monitoring equipment. For example, an audio signal may be generated that is synchronized with a ligature device, and the audio signal may provide an indication of when an electrode of the ligature device is activated. In such a case, the first location may be located adjacent to an area where the ligature device is being operated, or a video monitor used to observe a location of the ligature device, for example. In some examples, the audio signal may be focused at the first location, with sound levels of the audio signal at the first location exceeding sound levels of locations adjacent the first location by a substantial amount. In some embodiments, a surface may be placed at the first location that is configured to reflect the audio signal toward one or more persons in the operating room.

In another aspect, a system for providing audio to one or more individuals in an operating room is provided. The system generally includes a first ultrasonic signal generator located in an operating room and configured to generate a first ultrasonic signal directed at a first location in the operating room, a second ultrasonic signal generator located in the operating room and configured to generate a second ultrasonic signal directed at the first location in the operating room, and a controller coupled with the first and second ultrasonic signal generators and configured to control the first and second ultrasonic signal generators to generate the first and second ultrasonic signals directed at the first location, the first and second ultrasonic signals combining to generate an audio signal that appears to emanate from the first location of the operating room. The controller, in some examples, may be coupled with one or more information source located in the operating room, and the audio signal may be synchronized with information output from the information source. Such an information source may be, for example, a surgical device and/or a condition monitor for one or more vital statistics of a patient. In some examples, the controller may be configured to identify the first location within an operating room from which it is desired to have sound emanate, such identification being, for example, programmed into the controller or dynamically determined by the controller based on an identification of the first location.

The foregoing has outlined rather broadly the features and technical advantages of examples according to the disclosure in order that the detailed description that follows may be better understood. Additional features and advantages will be described hereinafter. The conception and specific examples disclosed may be readily utilized as a basis for modifying or designing other structures for carrying out the same purposes of the present disclosure. Such equivalent constructions do not depart from the spirit and scope of the appended claims. Features which are believed to be characteristic of the concepts disclosed herein, both as to their organization and method of operation, together with associated advantages will be better understood from the following description when considered in connection with the accompanying figures. Each of the figures is provided for the purpose of illustration and description only, and not as a definition of the limits of the claims.

BRIEF DESCRIPTION OF THE DRAWINGS

A further understanding of the nature and advantages of the embodiments may be realized by reference to the following drawings. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

The present disclosure generally relates to systems, devices and related methods for providing audio to one or more individuals in an operating room. An ultrasonic signal generator may be provided that provides two or more ultrasonic signals that combine to produce an audible signal at a desired location. The audio signal may be perceived by individuals in the operating room to emanate, for example, from a surface or location within the operating room, or the audio signal may be generated to provide an audible signal to one or more persons within a particular location within the operating room. Multiple audio signals may be generated to emanate from multiple different locations. Likewise, multiple audio signals may be generated to provide different audible signals in different locations in the operating room. Combinations may also be provided in some embodiments, in which an audio signal generator is configured to generate an audio signal that may be perceived to emanate from a first location and to generate another audio signal audible by persons within a particular location within the operating room.

Figure 1:
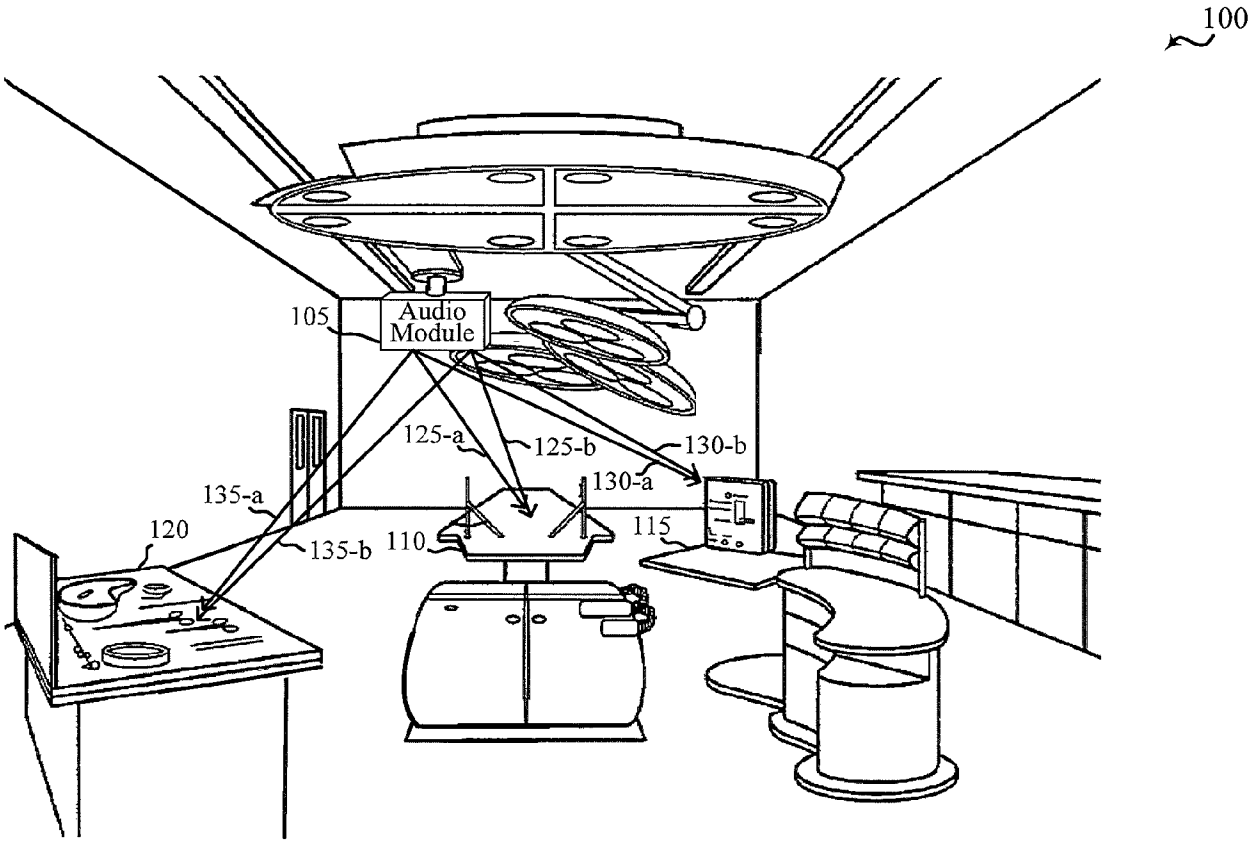
FIG. 1 is an illustration of an operating room and an audio module to provide audio to particular individuals, in accordance with various aspects of the present disclosure.

Referring now to FIG. 1, an example of an operating room 100 is described in accordance with various aspects of the present disclosure. The operating room 100 includes an audio module 105 that may be used to provide audio that may emanate from one or more particular locations and/or that provide audio that is focused at one or more particular locations. In the example of FIG. 1, an operating table 110 is located centrally in the operating room 100, with an anesthesiologist monitor 115 and station located adjacent one end of the operating table 110. A nurse's station 120 is located in the operating room 100 of this example, in an area somewhat away from the operating table 110. As discussed above, a number of different people may be working in such an operating room 100 during a surgical procedure. For example, a surgeon and a resident may perform a surgical procedure on a patient, with assistance from a scrub nurse, with each of these individuals potentially being within a sterile field associated with a particular area of the patient undergoing the surgical procedure.

In some procedures, the surgeon may utilize surgical equipment that may emit audible sounds to indicate various states of operation or status associated with the equipment. In such cases, the audible indications may only be relevant to the individuals working within the sterile field, and may potentially serve as a distraction to individuals to which the audible indications are not relevant to their responsibilities. For example, an anesthesiologist may be responsible for maintaining the proper state of consciousness and/or anesthesia for the patient, as well as monitoring various vital statistics of the patient. The anesthesiologist may use one or more anesthesia monitors 115 as part of their responsibilities, which may also provide audible indications associated with the condition being monitored. Similarly as above, these audible indications from anesthesia monitor(s) 115 may only be relevant to the individual(s) responsible for anesthesia, and may potentially serve as a distraction to other individuals in the operating room 100. Other individuals may also be present in operating room 100 during a surgical procedure, such as, for example, one or more circulating nurses, who may provide support to other individuals in the operating room 100. Similarly such other individuals may monitor one or more pieces of equipment that provide audible indications, which may not be desirable for others in the operating room 100 to hear.

In the example of FIG. 1, audio module 105 may provide audio signals to one or more locations or areas within operating room 100 that are focused such that the audio signals are heard most prominently by the relevant individuals, and heard at a significantly lower sound level, or not heard at all, by individuals to which the audio signals are not relevant. The audio module 105, according to some embodiments, generates two or more ultrasonic signals that may mix to create a new audio frequency that may be heard by individuals at a desired location. For example, the audio module 105 may generate ultrasonic signals 125-*a* and 125-*b* that may combine to generate an audio signal that may be heard by individuals within the vicinity of the operating table 110, but not by individuals outside of the vicinity of the operating table 110. In some examples, sound levels of the audio signal at the desired location exceed sound levels of locations adjacent the desired location by at least 60%. Furthermore, in some procedures, a surgeon may be performing a laparoscopic or other minimally invasive procedure in which the surgeon may use a monitor to observe the location of the piece of surgical equipment. In such situations, it may be desirable to have an audio signal emanate from the monitor rather than from some other location within operating room 100. In such cases, signals 125-*a* and 125-*b* may be directed such that an audio signal may be reflected from a surface of such a monitor, as will be described in more detail below.

In some examples, the ultrasonic signals 125-*a* and 125-*b* may be generated by two or more ultrasonic signal generators in an array of ultrasonic signal generators, as will be described in more detail below, to provide an audio signal that is audible by individuals working within the sterile field associated with the patient. For example, multiple audio modules 105 may be included at different locations in an operating room, and may be used to provide focused audio to two or more different locations. In some examples, multiple audio modules 105 may also be used to provide audio in areas that may be physically blocked, such as by a boom or light that impedes a line of sight between an audio module 105 and the area to focus the audio. In such cases, one or more audio modules 105 that are not blocked may be used to provide such audio.

In the example of FIG. 1, the audio module 105 may also generate ultrasonic signals 130-*a* and 130-*b* that may combine to generate an audio signal that may be heard by individuals within the vicinity of anesthesia monitor(s) 115, but not by individuals outside of the vicinity of the anesthesia monitor(s) 115. Similarly as above, the ultrasonic signals 130-*a* and 130-*b* may be generated by two or more ultrasonic signal generators at the audio module 105, and/or by multiple audio modules 105. The audio signal produced by the mixing of ultrasonic signals 130-*a* and 130-*b* may be focused such that the audio signal is audible only by the anesthesiologist and/or others in the vicinity of monitor(s) 115, or may be directed such that the audio signal may be reflected from a surface of the anesthesia monitor(s) 115. Likewise, the audio module 105 may also generate ultrasonic signals 135-*a* and 135-*b* that may combine to generate an audio signal that may be heard by individuals within the vicinity of nurses station 120, but not by individuals outside of the vicinity of the nurses station 120. Again, the ultrasonic signals 135-*a* and 135-*b* may be generated by two or more ultrasonic signal generators at the audio module 105, with an audio signal produced by the mixing of ultrasonic signals 135-*a* and 135-*b* focused in the desired location. Such audio signals may be of interest, for example, to a circulating nurse that may provide an indication that some action needs to be taken or that an instrument or piece of equipment used by the surgeon may need to be serviced. For example, a surgeon may be using a battery operated instrument, and an audible indication that the battery charge is becoming depleted may be provided to the circulating nurse who may then provide a replacement battery to the scrub nurse. Of course, the examples provided herein are provided for the purposes of illustration and discussion, and numerous different examples of situations where directive audio may be used will be readily apparent to one of skill in the art.

Figure 2:
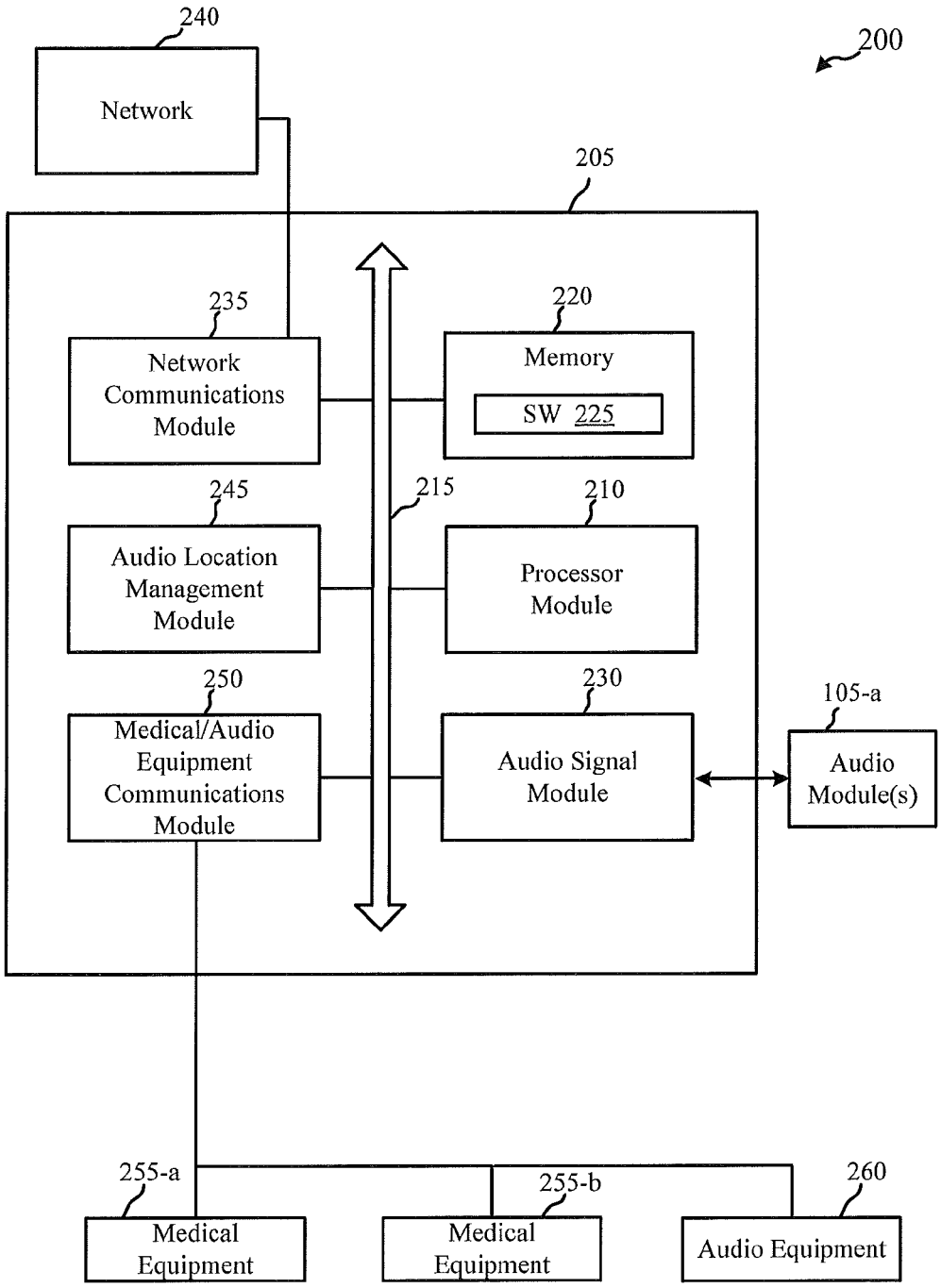
FIG. 2 is a block diagram of an audio generation system in accordance with various embodiments of the present disclosure.

As discussed above, the audio generator 105 of FIG. 1 may provide directed or focused ultrasonic signals that may combine to produce a desired audio signal at a desired location. FIG. 2 shows a block diagram of an audio generation system 200 in accordance with various embodiments of the disclosure. The audio generation system 200 is coupled with audio module 105-*a*, and provides signals to the audio module to generate ultrasonic signals to produce one or more audio signals at one or more desired locations. The audio module 105-*a* may be an example of audio module 105 of FIG. 1, that is located within an operating room. In the example of FIG. 2, a controller 205 is coupled with audio module 105-*a* and controls the audio module 105-*a* to generate the appropriate ultrasonic signals. The controller 205 may be integrated into audio module 105-*a* or may be connected to audio module 105-*a* through a wired or wireless connection. Controller 205 may also be located within an operating room, or may be located outside of the operating room. In the example of FIG. 2, controller 205 may include a processor module 210, a memory module 220, an audio signal module 230, a network communications module 235 coupled with a remote network 240, an audio location management module 245, and a medical/audio equipment communications module 250. Each of these components may be in communication with each other, directly or indirectly, over one or more buses 215.

The memory module 220 may include random access memory (RAM) and read-only memory (ROM). The memory module 220 may also store computer-readable, computer-executable software (SW) code 225 containing instructions that are configured to, when executed, cause the processor module 210 to perform various functions described herein for providing audio signals to desired locations within an operating room. Alternatively, the software code 225 may not be directly executable by the processor module 210 but be configured to cause the computer, e.g., when compiled and executed, to perform functions described herein.

The processor module 210 may include an intelligent hardware device, e.g., a central processing unit (CPU), a microcontroller, an application-specific integrated circuit (ASIC), etc. The processor module 210 may process information received through the audio location management module 245, the medical/audio equipment communications module 250, the audio signal module 230, and/or the network communications module 235. The processor module 210 may handle, alone or in connection with audio location management module 245, various aspects related to determination of particular audio signals that are to be provided to particular locations within the operating room, as discussed herein.

The medical/audio equipment communications module 250 may be coupled with one or more pieces of medical equipment 255-*a*, 255-*b*, and/or other audio equipment 260. Medical equipment 255 may include, for example, a surgical instrument and/or monitor that may be used during a surgical procedure. Audio equipment 260 may include, for example, audio equipment associated with an operating room such as for voice communication with individuals outside of the operating room, or an audio system that may be used to provide music to a surgeon and/or patient. Medical equipment 255-*a*, 255-*b* may provide an information source to which audio signals generated by system 200 may be synchronized. As discussed above, audio signals associated with one piece of medical equipment, such as medical equipment 255-*a*, may be provided only to certain individuals within an operating room, or may be provided only to certain locations within the operating room. For example, if the medical equipment 255-*a* is a piece of monitoring equipment used by an anesthesiologist, the audio associated with the medical equipment 255-*a* may be provided to the anesthesiologist through the generation of ultrasonic signals from two or more ultrasonic signal generators within audio module 105-*a* that combine to provide an audio signal at a first location in the operating room associated with the anesthesiologist. The audio signal may be generated such that it may be heard by individuals located at or adjacent to the first location, or such that it appears to emanate from a surface located at the first location, such as a monitor screen at the first location. Similarly, medical equipment 255-*b* may include, for example, a surgical instrument with the audio system 200 providing an audio signal to a second location in the operating room associated with a surgeon that is operating the surgical instrument.

According to the architecture of FIG. 2, the controller 205 may include an audio location management module 245. The audio location management module 245 may manage the generation of ultrasonic signals from ultrasonic signal generators in audio module 105-*a* to produce desired audio signals at one or more particular locations within the operating room. The audio location management module 245 may be programmed, for example, to provide signals associated with a particular piece of equipment to a predefined location in an operating room. For example, if medical equipment 255-*a* is an anesthesia monitor, audio location management module 245 may be programmed with a particular location within the operating room that is associated with an anesthesiologist, and thus provide associated audio signals to the programmed location.

In some embodiments, the audio location management module 245 may determine the type of equipment coupled with medical/audio equipment communications module 250. Particular types of equipment may be associated with particular locations in the operating room, and thus the audio location management module 245 may provide associated audio signals to locations in the operating room in accordance with the determined type of equipment. In still further embodiments, the audio location management module 245 may be coupled with a monitoring system to monitor a particular location within an operating room for one or more individuals that are to receive audio signals associated with a piece of medical equipment 255 or audio equipment 260. Thus, appropriate audio signals may be provided to the monitored individual as they move around the operating room. Similarly, audio location management module 245 may monitor the location of a particular item, such as a surgical monitor screen, from which audio associated with a piece of equipment is to emanate. In such a manner, audio may emanate from the desired monitor screen even if the monitor screen is moved within the operating room. The audio location management module 245 may monitor the location of persons or equipment in an operating room through one or more techniques, such as through a visual or radio tag worn by one or more individuals or placed on a piece of equipment that may be monitored to determine the location within the operating room of the individual or item. The audio signal(s) for the individual or item may thus be directed to the proper location to be heard by the proper personnel. Combinations may also be provided in some embodiments, in which an audio module 105-*a* is configured to generate an audio signal that may be perceived to emanate from a first location and to generate another audio signal audible by persons within a particular location within the operating room.

The audio location management module 245 may be in communication with some or all of the other components of the controller 205 via the bus or buses 215. Alternatively, functionality of the audio location management module 245 may be implemented as a component of the audio signal module 230, as a component of the medical/audio equipment communications module, as a computer program product, and/or as one or more elements of the processor module 210. The components of the controller 205 may be configured to implement aspects discussed above with respect to FIG. 1, and those aspects may not be repeated here for the sake of brevity. Moreover, the components of the controller 205 may be configured to implement aspects discussed below with respect to FIGS. 3-14 and those aspects may not be repeated here also for the sake of brevity.

Figure 3:
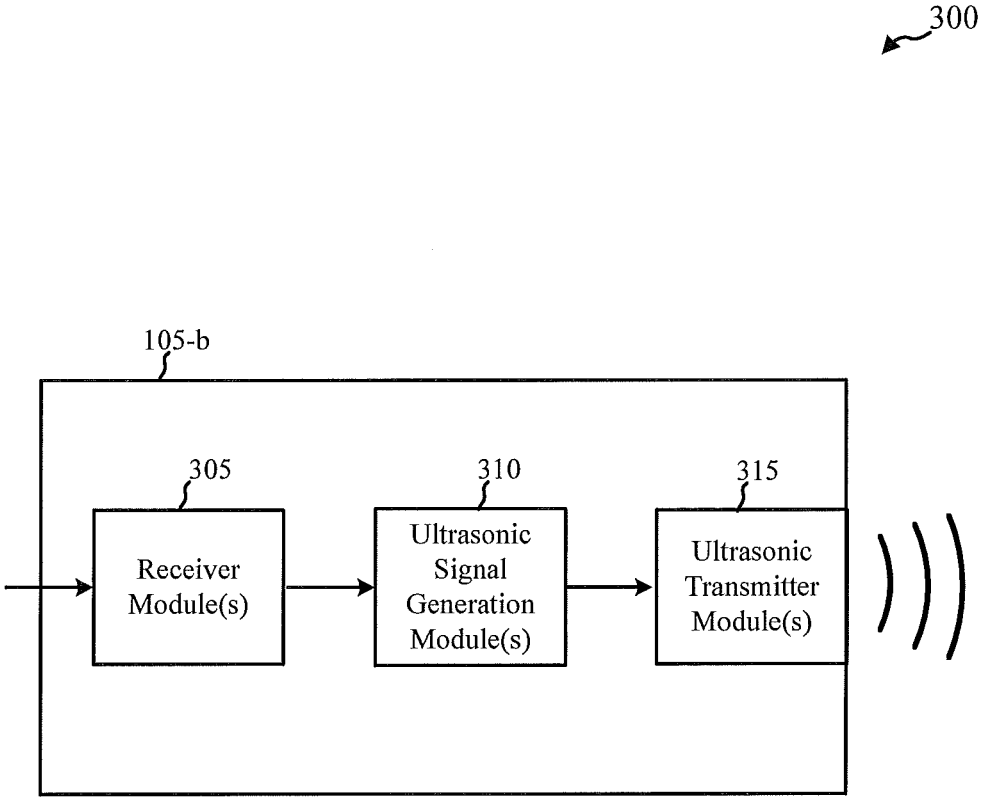
FIG. 3 is a block diagram of an audio module in accordance with various embodiments of the present disclosure.

With reference now to FIG. 3, a block diagram illustrates an audio module 105-*b* that may be used for generation of an audio signal focused at a particular location within an operating room or that that appears to emanate from a particular location within an operating room, in accordance with various embodiments. The audio module 105-*b* may be an example of one or more aspects of the audio modules 105 described with reference to FIGS. 1-2, or FIG. 4-5 or 9-11 as will be described below. The audio module 105-*b* may include one or more receiver module(s) 305, an ultrasonic signal generation module 310, and one or more ultrasonic transmitter module(s) 315. Each of these components may be in communication with each other. The receiver module 305 and ultrasonic signal generation module 310, or portions thereof, may also be a processor. The audio module 105-*b* through the receiver module 305, the ultrasonic signal generation module(s) 310, and the ultrasonic transmitter module(s) 315, may be configured to transmit ultrasonic signals that combine with one or more other ultrasonic signal (transmitted by audio module 105-*b* and/or some other audio module) to produce an audio signal at a desired location, similarly as discussed above with respect to FIGS. 1-2.

The ultrasonic transmitter module(s) 315 may include a number of ultrasonic signal generators that transmit ultrasound waves. The ultrasonic signals may mix together and produce directive, low-frequency sound waves, through nonlinear interaction of the aimed ultrasonic signals. An ultrasonic signal generator can be made to project a narrow beam of modulated ultrasound that is powerful enough, at 100 to 110 dBSPL, to substantially change the speed of sound in the air that it passes through. The air within the beam behaves nonlinearly and extracts the modulation signal from the ultrasound, resulting in an audible sound that can be heard only along the path of the beam, or that appears to radiate from a surface that the beam strikes. In such a manner, audio module 105-*b* may provide a beam of audible sound that may be projected over a relatively long distance to be heard only in a relatively small well-defined location. Such ultrasonic sound generation is known in the art, and not described here in further detail.

Figure 4:
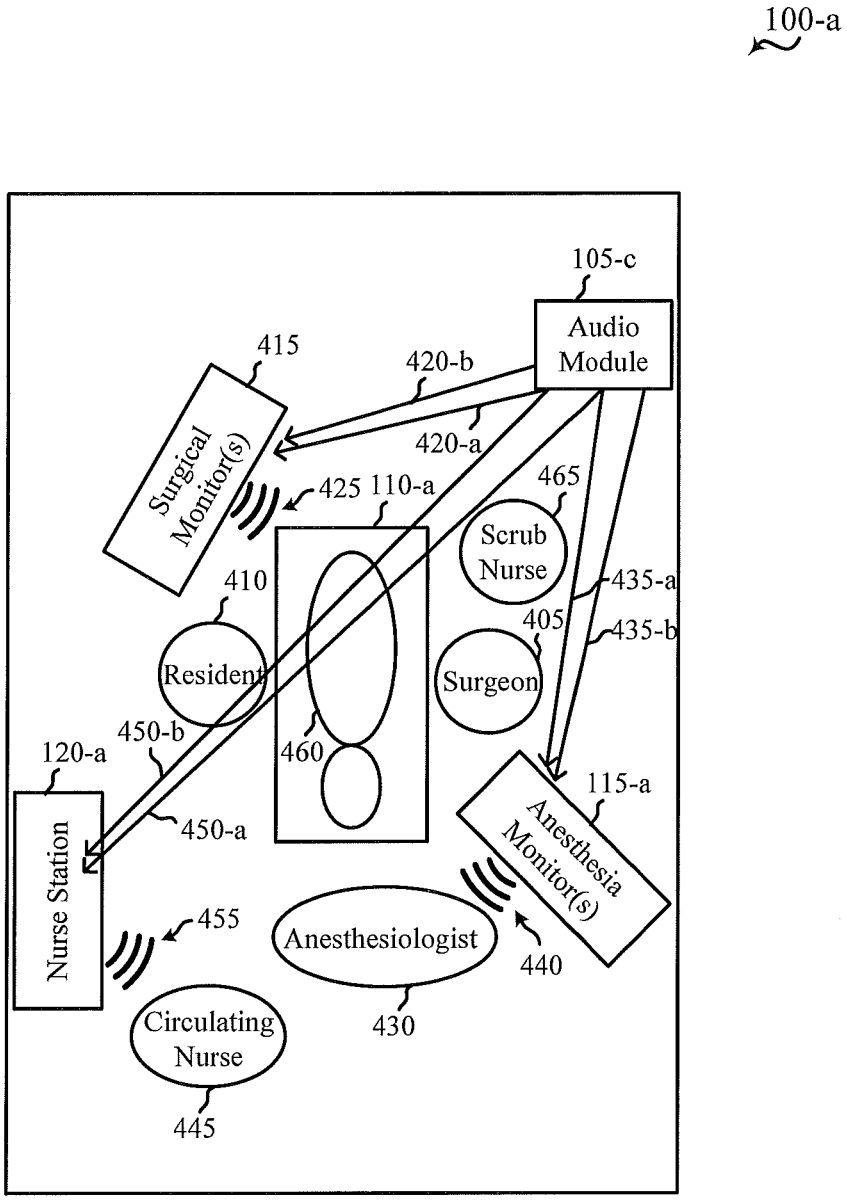
FIG. 4 is an illustration of an operating room and audio module that may direct audio to emanate from desired locations in accordance with various embodiments of the present disclosure.

With reference now to FIG. 4, an example of an operating room 100-*a* is described in which audio is provided that appears to emanate from particular locations within the operating room 100-*a*. In this example, a surgeon 405 and a resident 410 are located on either side of operating table 110-*a*. The surgeon 405 and/or resident 410 may utilize one or more surgical monitor(s) 415 as part of a procedure being performed on a patient 460. For example, surgeon 405 may be performing a laparoscopic procedure and the surgical monitor(s) 415 may provide a video image associated with a ligature device being employed in the procedure. The surgeon 405 and/or resident 410 may observe the surgical monitor(s) 415 and activate the ligature device to seal a vessel as part of the laparoscopic procedure. In this example, audio module 105-*c* may generate ultrasonic signals 420-*a* and 420-*b* using two or more ultrasonic generators, with the ultrasonic signals 420-*a* and 420-*b* mixing to generate an audio signal 425 that appears to emanate from the surgical monitors) 415.

Continuing with the example of a ligature device used in a laparoscopic procedure, the audio signal 425 may provide an indication of when an electrode of the ligature device is activated, thus providing an indication to the surgeon 405 and/or resident 410 that the ligature device is active and sealing the vessel. In some examples, such a ligature device may automatically deactivate the electrode after a certain time period or when a sensor detects that a certain temperature of the associated tissue has been achieved. At this point, the audio signal 425 may change to indicate that the ligation of the vessel is complete, and the ligature device may be moved. In some embodiments, the audio module 105-*c* may provide ultrasonic signals to a location associated with the patient 460, and an audio signal may appear to emanate from a location on the patient adjacent to where a surgical instrument may be used. For example, a surgeon may be performing an open procedure and using a ligature device to seal one or more vessels. In such a situation, it may be desirable to provide an audio signal that appears to emanate from a location adjacent to where the ligature device is being operated. In some embodiments, the surgical device in such an open procedure may be affixed with a tag, such as a radio or visual tag, that may be detected by audio module 105-*c* or a controller associated with audio module 105-*c*, that may be used to determine the location in the operating room from which it is to appear that sound is emanating. In other embodiments, a controller associated with the audio module 105-*c*, such as controller 205 of FIG. 2, for example, may be programmed with a location from which audio associated with the surgical device is to emanate. In still other embodiments, a target surface may be placed adjacent to the location from which audio associated with the surgical device is to emanate. Such a target surface may include, for example, a visual or radio tag that may be used to provide location information to audio module 105-*c* and/or an associated controller. Such a target surface may also provide a surface that may reflect an audio signal that is generated from two or more ultrasonic beams.

Continuing with the example of FIG. 4, an anesthesiologist 430 may be located in operating room 100-*a* at a location adjacent to one or more anesthesia monitor(s) 115-*a*. The anesthesia monitor(s) 115-*a* may be coupled with one or more pieces of medical equipment that the anesthesiologist 430 uses to monitor the patient 460. Audio module 105-*c* may generate ultrasonic signals 435-*a* and 435-*b* directed to the anesthesia monitor(s) 115-*a* that combine to generate audio signal 440 that appears to emanate from anesthesia monitor(s) 115-*a*. In such a manner, the anesthesiologist 430 may be provided with audio signal(s) 440 that are synchronized with corresponding monitoring equipment. In some embodiments, the audio signal 425 from surgical monitor(s) 415 is provided to a relatively localized area associated with surgical monitors, such that the anesthesiologist 430 does not hear audio signal 425, or hears the audio signal 425 at a relatively low level. Likewise, anesthesiologist 430 may hear audio signal 440 relatively clearly, while surgeon 405 and resident 410 hear audio signal 440 only at a relatively low level, if at all. Thus, different audio signals may be provided to different individuals in the operating room 100-*a*. Likewise, a circulating nurse 445 may be in operating room 100-*a* and may spend significant amounts of time in proximity to nurse station 120-*a*. Audio module 105-*c* may provide ultrasonic signals 450-*a* and 450-*b* that are directed to a target surface at nurse station 120-*a*, which may combine to produce audio signal 455 that appears to emanate from nurse station 455. In the example, of FIG. 4, a scrub nurse 465 may be present in the operating room 100-*a*, and work adjacent surgeon 405. The scrub nurse 465 may be outside of an area that may hear audio signals 425, and thus the scrub nurse 465 may not be distracted by such audio. In various embodiments, such a scrub nurse 465 may receive another separate audio signal that may convey information pertinent to the scrub nurse's duties in the operating room, such as audio that may provide an indication that the surgeon is due to take some type of action, or that a piece of surgical equipment used by the surgeon 405 is to be replaced or otherwise maintained, for example.

Figure 5:
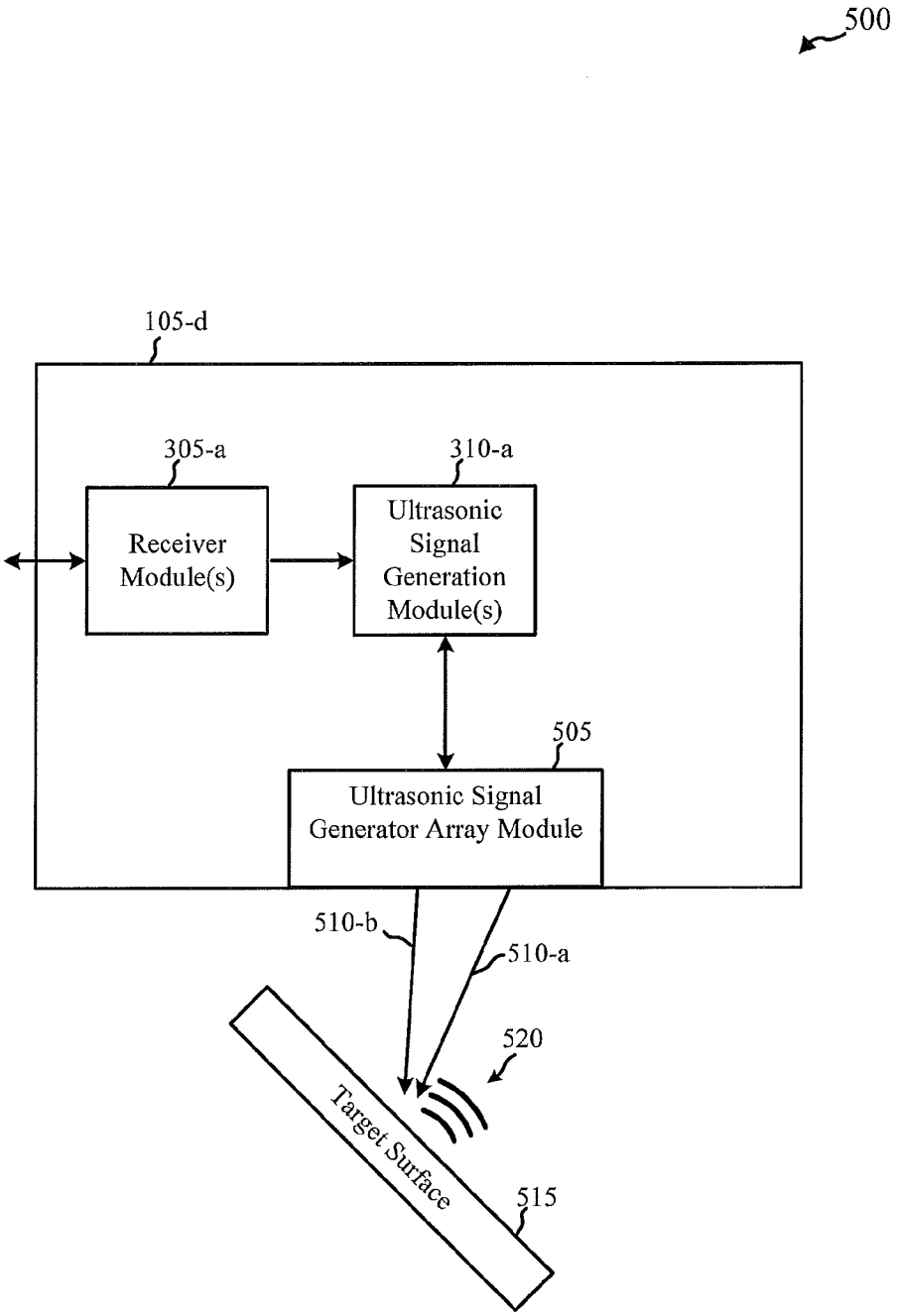
FIG. 5 is a block diagram of an audio module and target surface in accordance with various embodiments of the present disclosure.

Referring now to FIG. 5, a block diagram 500 illustrates an audio module 105-*d* that may be used for generation of an audio signal that that appears to emanate from a particular location within an operating room, in accordance with various embodiments. The audio module 105-*d* may be an example of one or more aspects of the audio modules 105 described with reference to FIGS. 1-4. The audio module 105-*d* may include one or more receiver module(s) 305-*a*, an ultrasonic signal generation module 310-*a*, and ultrasonic signal generator array module 505. Each of these components may be in communication with each other. The receiver module 305-*a* and ultrasonic signal generation module 310-*a*, or portions thereof, may also be a processor. The audio module 105-*d* through the receiver module 305-*a*, the ultrasonic signal generation module(s) 310-*a*, and the ultrasonic signal generator array module 505, may be configured to transmit ultrasonic signals toward a target surface 515. In this example, ultrasonic signal generator array module 505 generates ultrasonic signals 510-*a* and 510-*b*, that combine to produce audio signal 520 that appears to emanate from target surface 515.

The ultrasonic signal generator array module 505 may include a number of ultrasonic signal generators that transmit ultrasound waves. A controller may be coupled with the audio module 105-*d*, such as controller 205 of FIG. 2, for example, which may control ultrasonic signal generation module(s) 310-*a* to provide signals to ultrasonic signal generator array module 505 to generate ultrasonic signals 510-*a* and 510-*b*. In other embodiments, the ultrasonic signal generation module(s) 310-*a* may be programmable to provide ultrasonic signals at desired locations or target surfaces such as, for example, programming of particular locations for the ultrasonic signal transmissions, or determination of one or more locations or target surfaces through a tag associated with the location(s), similarly as discussed above. An individual adjacent to the target surface 515, will hear audio signal 520 which will be perceived as emanating from the target surface 515. The target surface 515, similarly as discussed above, may include a monitor screen for a surgeon or anesthesiologist, a surface placed at a location proximate an area of a procedure of a patient, or an area associated with a particular person or persons in an operating room, to name but a few examples.

Figure 6:
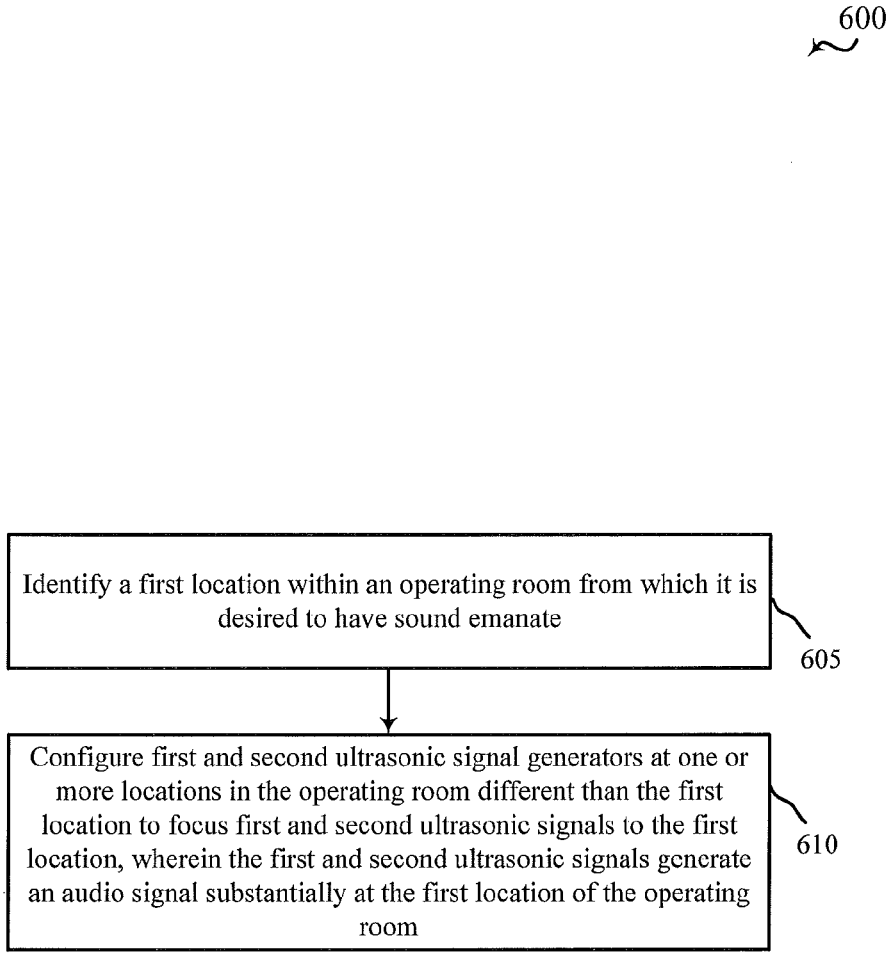
FIG. 6 is a flowchart of an example of operations related to generating an audio signal at a location from which it is desired to have sound emanate according to various embodiments.

Turning next to FIG. 6, a flow diagram is described for a method 600 for providing audio to one or more individuals in an operating room in accordance with various embodiments. The method 600 may be implemented using, for example, audio modules 105 of FIGS. 1-5, and/or controller 205 of FIG. 2, for example. At block 605, a first location is identified within an operating room from which it is desired to have sound emanate. Similarly as discussed above, the first location may be a location associated with a particular individual in an operating room, such as a surgeon and/or an anesthesiologist. Such a location may be, for example, a monitor screen that is used by such an individual to monitor some aspect of the patient or procedure. The first location may be identified through programming of an audio module or controller with information related to the first location within the operating room, or through a determination made by an audio module or controller that a particular location is the first location. Such a determination may be made, for example, through the identification of a tag or other identifying feature located at or near the first location and an identification that the particular tag or identifying feature corresponds to a particular audio signal, such as a signal from a particular piece of medical equipment located in the operating room.

At block 610, first and second ultrasonic signal generators at one or more locations in the operating room different than the first location are configured to focus first and second ultrasonic signals to the first location, wherein the first and second ultrasonic signals generate an audio signal substantially at the first location of the operating room. When referring to substantially at the first location, reference is made to an audio signal that may be audible to persons located within the first location, and that fades relatively quickly outside of the first location. The area covered by the particular location may be, in some examples, a relatively small area that may be occupied by a single person, or a relatively larger area that may be occupied by several persons. The ultrasonic generators may be part of, for example, an ultrasonic signal generator array that may generate two or more ultrasonic signals that combine at or near the first location to provide an audio signal with the perception that the audio signal emanated from the first location.

Figure 7:
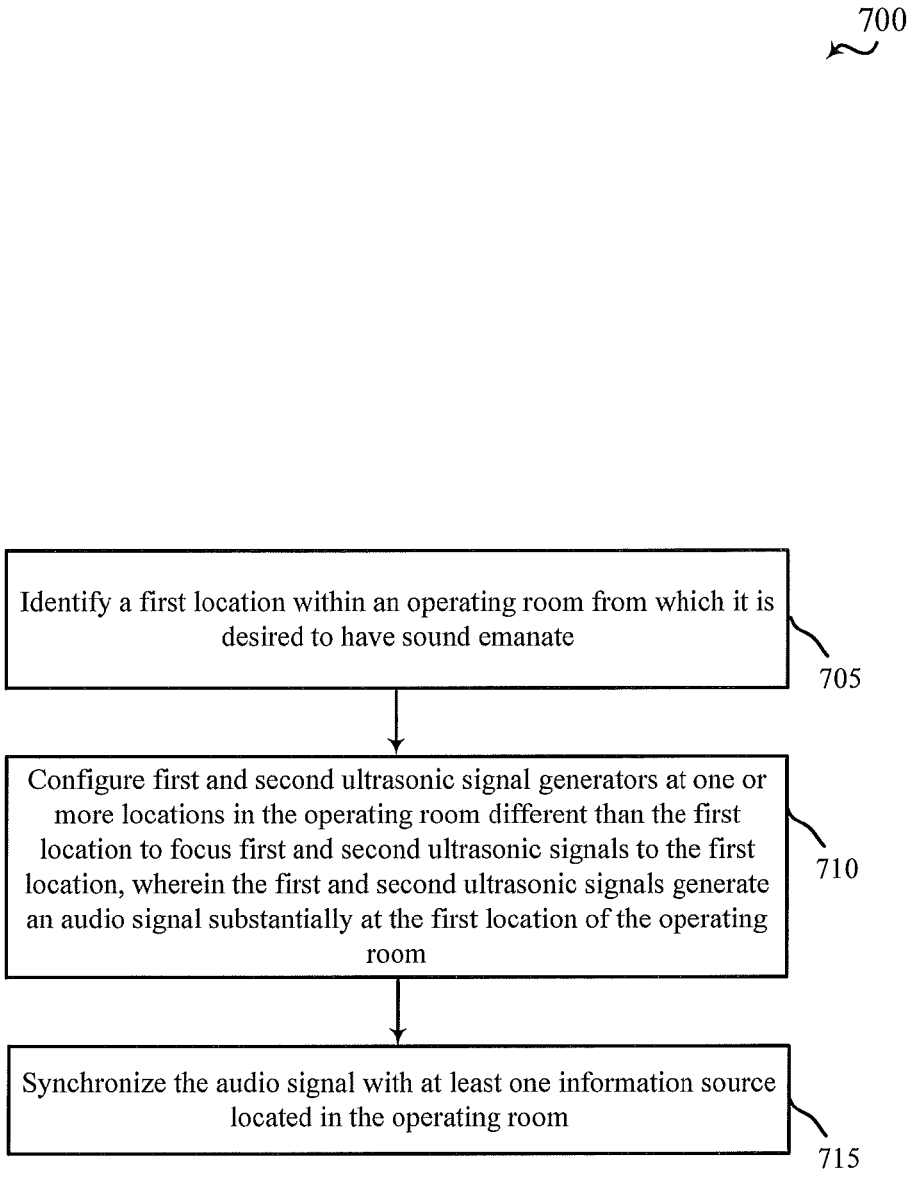
FIG. 7 is another flowchart of an example of operations related to generating an audio signal at a location from which it is desired to have sound emanate according to various embodiments.

Turning next to FIG. 7, a flow diagram is described for a method 700 for providing audio to one or more individuals in an operating room in accordance with various embodiments. The method 700 may be implemented using, for example, audio modules 105 of FIGS. 1-5, and/or controller 205 of FIG. 2, for example. At block 705, a first location is identified within an operating room from which it is desired to have sound emanate. Similarly as discussed above, the first location may be a location associated with a particular individual in an operating room, such as a surgeon and/or an anesthesiologist, and may be, for example, a monitor screen that is used by such an individual to monitor some aspect of the patient or procedure. The first location may be identified, as discussed above, through programming of an audio module or controller with information related to the first location within the operating room, or through a determination made by an audio module or controller that a particular location is the first location.

At block 710, first and second ultrasonic signal generators at one or more locations in the operating room different than the first location are configured to focus first and second ultrasonic signals to the first location, wherein the first and second ultrasonic signals generate an audio signal substantially at the first location of the operating room. The ultrasonic generators may be part of, for example, an ultrasonic signal generator array that may generate two or more ultrasonic signals that combine at or near the first location to provide an audio signal with the perception that the audio signal emanated from the first location. At block 715, the audio signal is synchronized with at least one information source located in the operating room. Such an information source may be, for example, monitoring equipment or a surgical instrument, and the audio signal may be synchronized with the status of the piece of equipment or instrument.

The detailed description set forth above in connection with the appended drawings describes exemplary embodiments and does not represent the only embodiments that may be implemented or that are within the scope of the claims. The detailed description includes specific details for the purpose of providing an understanding of the described techniques. These techniques, however, may be practiced without these specific details. In some instances, well-known structures and devices are shown in block diagram form in order to avoid obscuring the concepts of the described embodiments.

Figure 8:
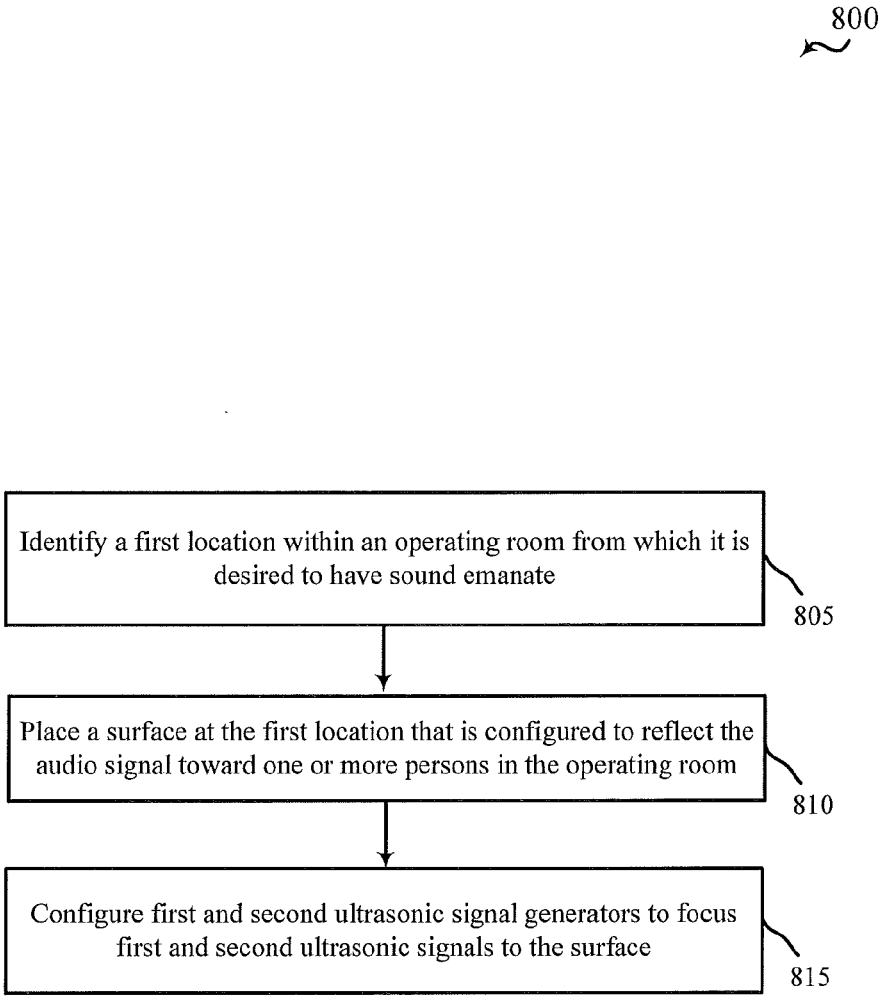
FIG. 8 is another flowchart of an example of operations related to generating an audio signal at a location from which it is desired to have sound emanate according to various embodiments.

Turning next to FIG. 8, a flow diagram is described for a method 800 for providing audio to one or more individuals in an operating room in accordance with various embodiments. The method 800 may be implemented using, for example, audio modules 105 of FIGS. 1-5, and/or controller 205 of FIG. 2, for example. At block 805, a first location is identified within an operating room from which it is desired to have sound emanate. Similarly as discussed above, the first location may be a location associated with a particular individual in an operating room, such as a surgeon and/or an anesthesiologist, and may be, for example, a monitor screen that is used by such an individual to monitor some aspect of the patient or procedure. In some embodiments, the first location may be an area on a patient that is adjacent or in proximity to a procedure that is to be performed on the patient. The first location may be identified, as discussed above, through programming of an audio module or controller with information related to the first location within the operating room, or through a determination made by an audio module or controller that a particular location is the first location.

At block 810, a surface is placed at the first location that is configured to reflect the audio signal toward one or more persons in the operating room. The surface may be, for example, a surface on a monitor screen that is viewed by the one or more persons, or may be a surface that may be placed on or near a patient, adjacent to an area where a procedure is to be performed on the patient. The surface may be a planar surface, or may be contoured to provide additional focusing of a resulting audio signal to a particular person or persons. At block 815, first and second ultrasonic signal generators are configured to focus first and second ultrasonic signals to the surface. The ultrasonic signals may mix to generate an audio signal that appears to emanate from the surface. The ultrasonic generators may be part of, for example, an ultrasonic signal generator array that may generate two or more ultrasonic signals that combine at or near the surface.

Figure 9:
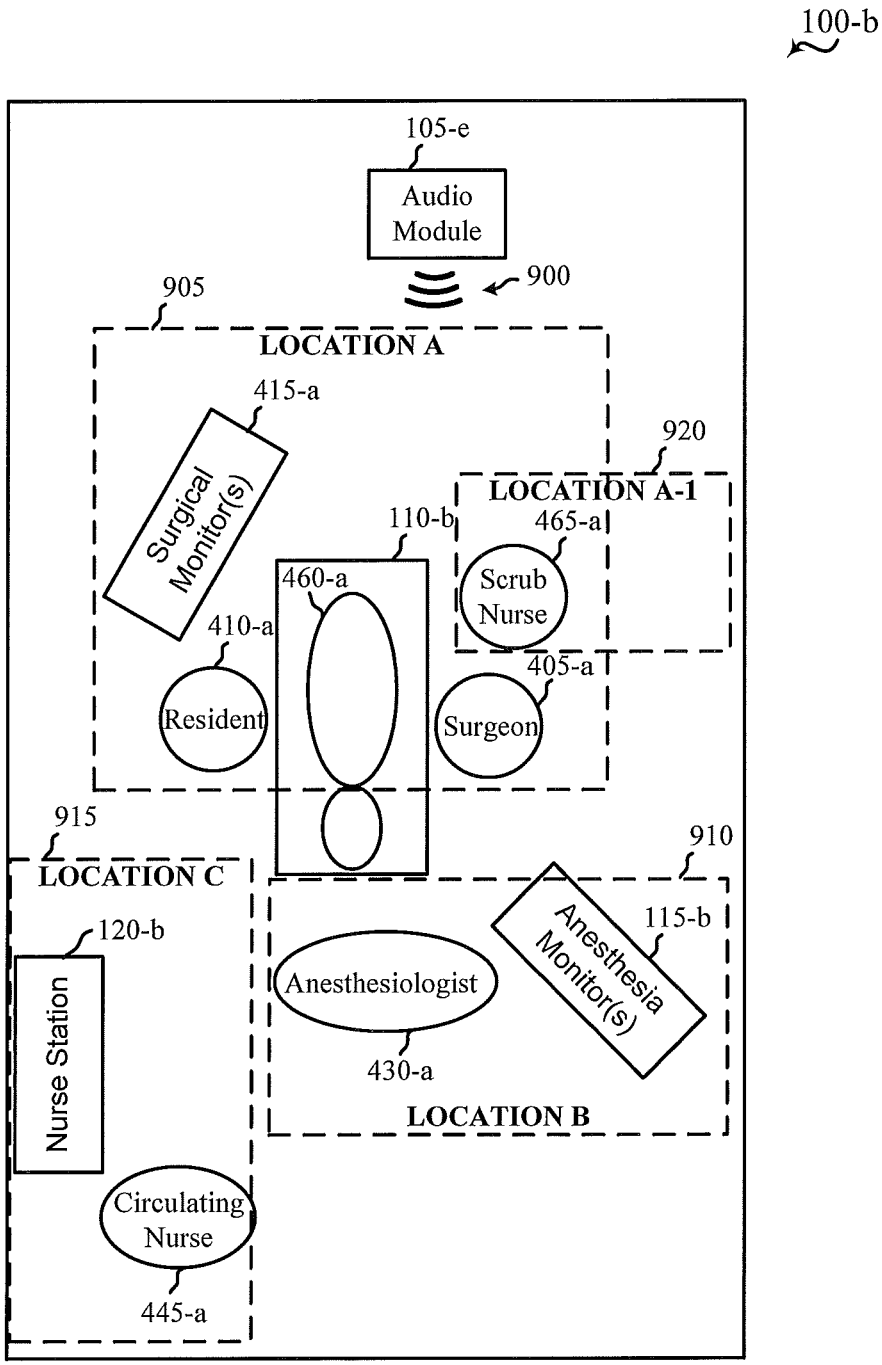
FIG. 9 is an illustration of an operating room and different locations that may receive different in accordance with various embodiments of the present disclosure.

With reference now to FIG. 9, an example of an operating room 100-*b* is described in which audio is provided to particular locations within the operating room 100-*b*. In this example, a surgeon 405-*a* and a resident 410-*a* are located on either side of operating table 110-*b*. The surgeon 405-*a* and/or resident 410-*a* may utilize one or more surgical monitor(s) 415-*a* as part of a procedure being performed on a patient 460-*a*. Similarly, as described with respect to FIG. 4, surgeon 405-*a* may be performing a laparoscopic procedure and the surgical monitor(s) 415-*a* may provide a video image associated with a ligature device being employed in the procedure. The surgeon 405-*a* and/or resident 410-*a* may observe the surgical monitor(s) 415-*a* and activate the ligature device to seal a vessel as part of the laparoscopic procedure. In this example, audio module 105-*e* may generate ultrasonic signals 900 using two or more ultrasonic generators, with the ultrasonic signals 900 mixing to generate separate audio signals for Location A 905, Location B 910, and Location C 915. In some embodiments, the audio signal for Location A 905 has a sound level that is high enough within Location A 905 to be heard by individuals within Location A 905, namely surgeon 405-*a*, resident 410-*a*, and scrub nurse 465-*a*, and has a lower sound level outside of Location A 905. Likewise, audio signals for Locations B and C 910, 915 have a higher sound level within Locations B 910 and C 915, respectively, than outside of Locations B 910 and C 915.

In the example of FIG. 9, an exemplary ligature device used in a laparoscopic procedure may be in communication with audio module 105-*e* through a wired or wireless connection, optionally through a separate controller such as controller 205 of FIG. 2, for example. An audio signal provided to Location A 905 in such an example may provide an indication of when an electrode of the ligature device is activated, thus providing an indication to the surgeon 405 and/or resident 410 that the ligature device is active and sealing the vessel. In some examples, such a ligature device may automatically deactivate the electrode after a certain time period or when a sensor detects that a certain temperature of the associated tissue has been achieved. At this point, the audio signal provided to Location A 905 may change to indicate that the ligation of the vessel is complete, and the ligature device may be moved. In some embodiments, a controller associated with the audio module 105-*e*, such as controller 205 of FIG. 2, for example, may be programmed with a Locations A-C 905-915, along with one or more information sources associated with each of the Locations 905-915, such as a piece of medical equipment or surgical device, such that audio signals associated with the information sources may be provided to the respective Locations 905-915.

In other embodiments, audio module 105-*e*, or an associated controller, may be programmed to provide audio to a location associated with a particular person in the operating room 100-*b*. Continuing with the above example, an anesthesiologist 430-*a* may be located in operating room 100-*a* at a location adjacent to one or more anesthesia monitor(s) 115-*b*. The anesthesia monitor(s) 115-*b* may be coupled with one or more pieces of medical equipment that the anesthesiologist 430-*a* uses to monitor the patient 460-*a*. Audio module 105-*e* may generate ultrasonic signals 900 to provide an audio signal to the location within the operating room 100-*b* associated with anesthesiologist 430-*a*. In some embodiments, audio module 105-*e* may monitor the location of anesthesiologist 430-*a*, such as through an optical or radio frequency sensor that may monitor the movement of anesthesiologist 430-*a*. In such embodiments, the anesthesiologist 430-*a* (or other individual) may wear some type of optical or RF tag that may be used to determine the location within the operating room 100-*b* of anesthesiologist 430-*a*. Ultrasonic signals 900 may then be generated to provide an audio signal to the location corresponding to the anesthesiologist 430-*a*. In such a manner, the anesthesiologist 430-*a* may be provided with audio signal(s) that are synchronized with corresponding monitoring equipment.

In another example, a scrub nurse 465-*a* may be present in the operating room 100-*b*, and work adjacent surgeon 405-*a*. The scrub nurse 465-*a* may desire to hear an audio signal associated with Location A 905. Furthermore, scrub nurse 465-*a* may desire to receive another separate audio signal that may convey information pertinent to the scrub nurse's 465-*a* duties in the operating room, such as audio that may provide an indication that the surgeon 405-*a* is due to take some type of action, or that a piece of surgical equipment used by the surgeon 405-*a* is to be replaced or otherwise maintained, for example. In such embodiments, scrub nurse 465-*a* may be identified as a separate location, Location A-1 920, that may receive both types of audible information desired by the scrub nurse 465-*a*.

Additionally or alternatively, the audio module 105-*e* may be coupled with a microphone that may receive audio signals from areas in the operating room 100-*b* outside of a location. For example, a circulating nurse 445-*a* in Location C 915, may receive audio signals relevant to the duties of the circulating nurse 445-*a*, but Location C may be located adjacent a relatively noisy area in operating room 100-*b*. In such embodiments, a microphone may receive the noise, and audio module 105-*e* may provide ultrasonic signals 900 to Location C 915 that cancel the audio received at the microphone, thereby reducing the noise that may be heard by the circulating nurse 445-*a* at Location C 915. Furthermore, in some embodiments, feedback from a microphone may be provided to the audio module 105-*e* and/or an associated controller that may be used to focus audio at particular locations. For example, such a microphone located in Location C may be used to determine that the ultrasonic signals from audio module 105-*e* are properly focused and may also be used to provide corrections real-time along with, or alternatively to, noise cancellation. Additionally or alternatively, microphones may be used to determine a location of an individual that is to receive an audio signal. For example, anesthesiologist 430-*a* may be fitted with a microphone and a signal from a transducer of audio module 105-*e* may be generated which is then measured (e.g., time of arrival and intensity) to provide feedback related to the location of anesthesiologist 430-*a* relative to the audio module 105-*e*. Likewise, other individuals may have microphones, and/or microphones may be provided at Locations A-C 905-920. In some embodiments, one or more transducers in audio module 105-*e* may be configured as microphones, and audio may be provided to a location from which sound is to emanate, such as a desk at nurse station 120-*b*. The transducers in the audio module 105-*e* may be used to measure the phase and intensity from that location and tune the audio.

Figure 10:
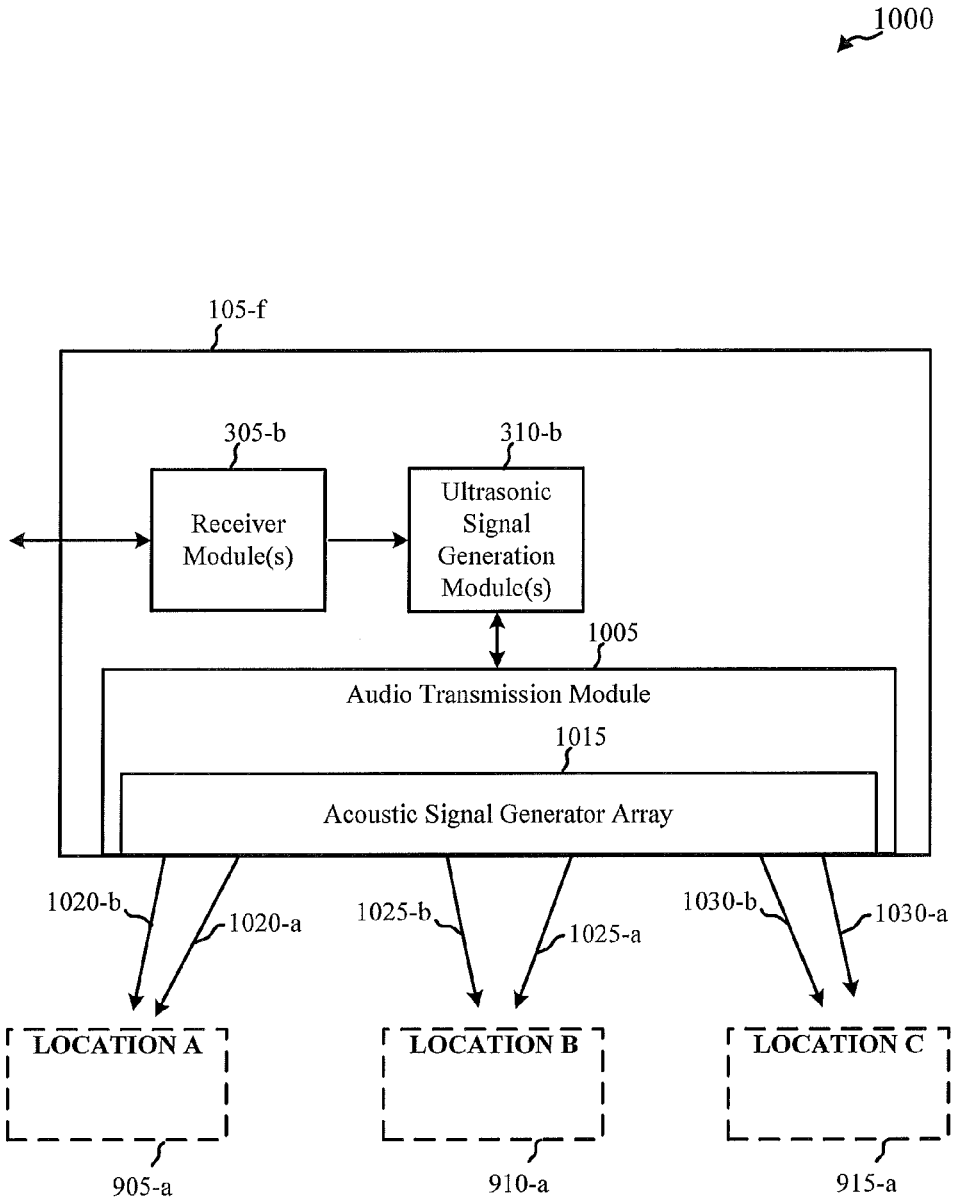
FIG. 10 is a block diagram of an audio module in accordance with various embodiments of the present disclosure.

Referring now to FIG. 10, a block diagram 1000 illustrates an audio module 105-*f* that may be used for generation of audio signals to particular locations within an operating room, in accordance with various embodiments. The audio module 105-*f* may be an example of one or more aspects of the audio modules 105 described with reference to FIG. 1-3 or 9. The audio module 105-*f* may include one or more receiver module(s) 305-*b*, an ultrasonic signal generation module 310-*b*, and an audio transmission module 1005 that may include an acoustic signal generator array 1015. Each of these components may be in communication with each other. The receiver module 305-*b* and ultrasonic signal generation module 310-*b*, or portions thereof, may also be a processor. The audio module 105-*f* through the receiver module 305-*b*, the ultrasonic signal generation module(s) 310-*b*, and the audio transmission module 1005, may be configured to transmit ultrasonic signals 1020-1030 to different locations 905-*a*-915-*a*. In this example, acoustic signal generator array 1015 generates ultrasonic signals 1020-*a* and 1020-*b*, that combine to produce an audio signal that may be heard at Location A 905-*a*. Similarly, acoustic signal generator array 1015 generates ultrasonic signals 1025-*a* and 1025-*b*, that combine to produce an audio signal that may be heard at Location B 910-*a*. Finally, in this example, acoustic signal generator array 1015 generates ultrasonic signals 1025-*a* and 1025-*b*, that combine to produce an audio signal that may be heard at Location C 915-*a*.

The acoustic signal generator array 1015 may include a number of ultrasonic signal generators that transmit ultrasound waves. A controller may be coupled with the audio module 1054, such as controller 205 of FIG. 2, for example, which may control ultrasonic signal generation module(s) 310-*b* to provide signals to audio transmission module 1005 and acoustic signal generator array 1015 to generate ultrasonic signals 1020, 1025, and 1030. In other embodiments, the ultrasonic signal generation module(s) 310-*b* may be programmable to provide ultrasonic signals at desired locations such as, for example, through programming of particular locations for the ultrasonic signal transmissions, or determination of one or more locations through a tag associated with the location(s) and/or person(s) associated with the location(s), similarly as discussed above.

Figure 11:
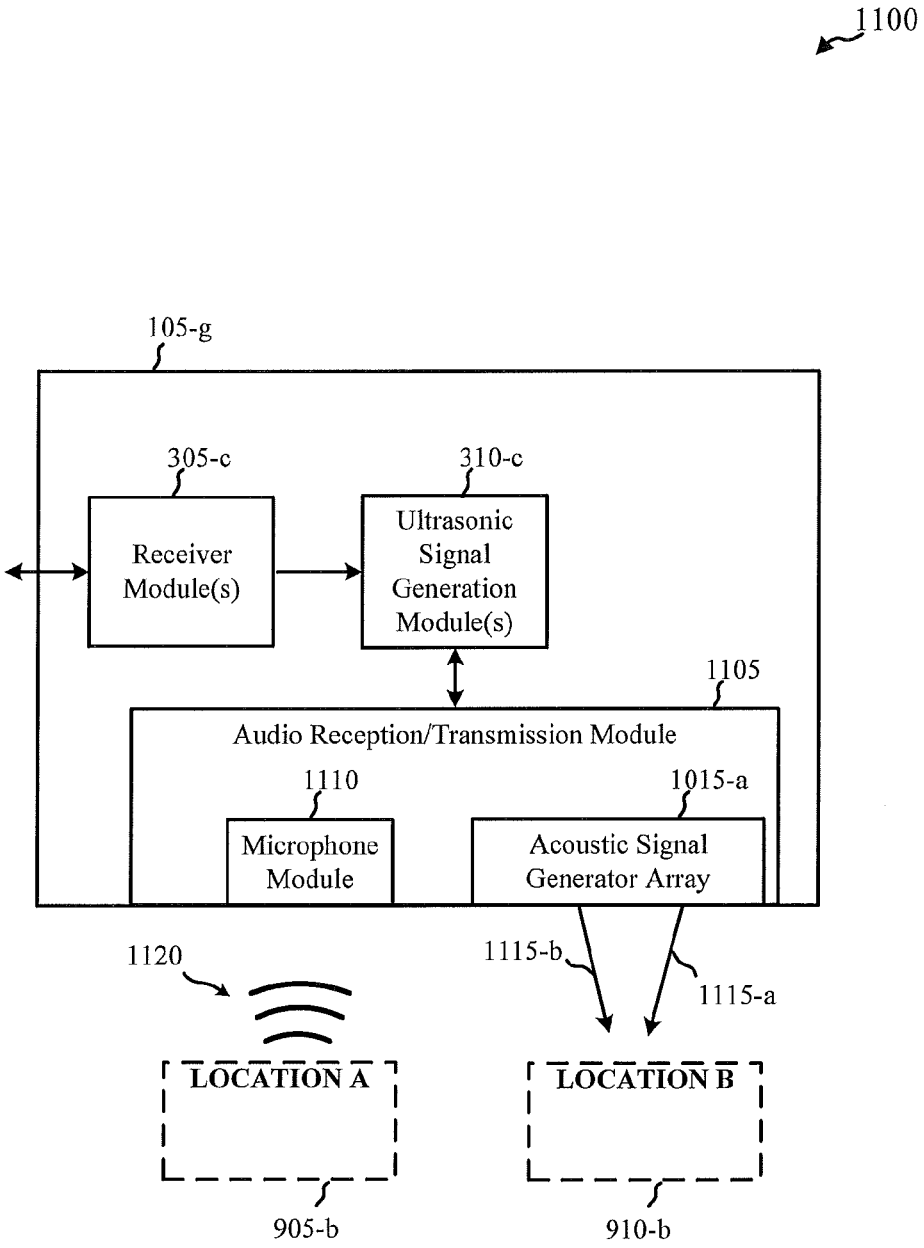
FIG. 11 is a block diagram of another audio module in accordance with various embodiments of the present disclosure.

Referring now to FIG. 11, a block diagram 1100 illustrates another audio module 105-*g* that may be used for generation of audio signals to particular locations within an operating room, in accordance with various embodiments. The audio module 105-*g* may be an example of one or more aspects of the audio modules 105 described with reference to FIG. 1-3 or 9-10. The audio module 105-*g* may include one or more receiver module(s) 305-*c*, an ultrasonic signal generation module 310-*c*, and an audio reception/transmission module 1105 that may include an acoustic signal generator array 1015-*a* and a microphone module 1110. Each of these components may be in communication with each other. The receiver module 305-*c* and ultrasonic signal generation module 310-*c*, or portions thereof, may also be a processor. The audio module 105-*g* through the receiver module 305-*c*, the ultrasonic signal generation module(s) 310-*c*, and the audio reception/transmission module 1005, may be configured to transmit ultrasonic signals 1115-*a* and 1115-*b* to Location B 910-*b*. In this example, microphone module 1110 may be configured to receive audio 1120 from Location A 905-*b*. Ultrasonic signal generation module 310-*c*, or an associated controller such as controller 205 of FIG. 2, may receive the signal from microphone module 1110 and adjust ultrasonic signals 1115-*a* and 1115-*b* to cancel the audio 1120 received at microphone module 1110. In such a manner, noise from location A 905-*b* may be canceled such that individuals in Location B 910-*b* hear a reduced level of noise, or unwanted sound, from Location A 905-*b*. Microphone module 1110 may include, for example, a microphone that receives audio 1120 from the operating room as a whole. In some embodiments microphone module 1110 may be coupled with one or more microphones located at different areas of the operating room, or may include an array of microphones, in other embodiments, that may be used to localize one or more sources of unwanted audio.

Figure 12:
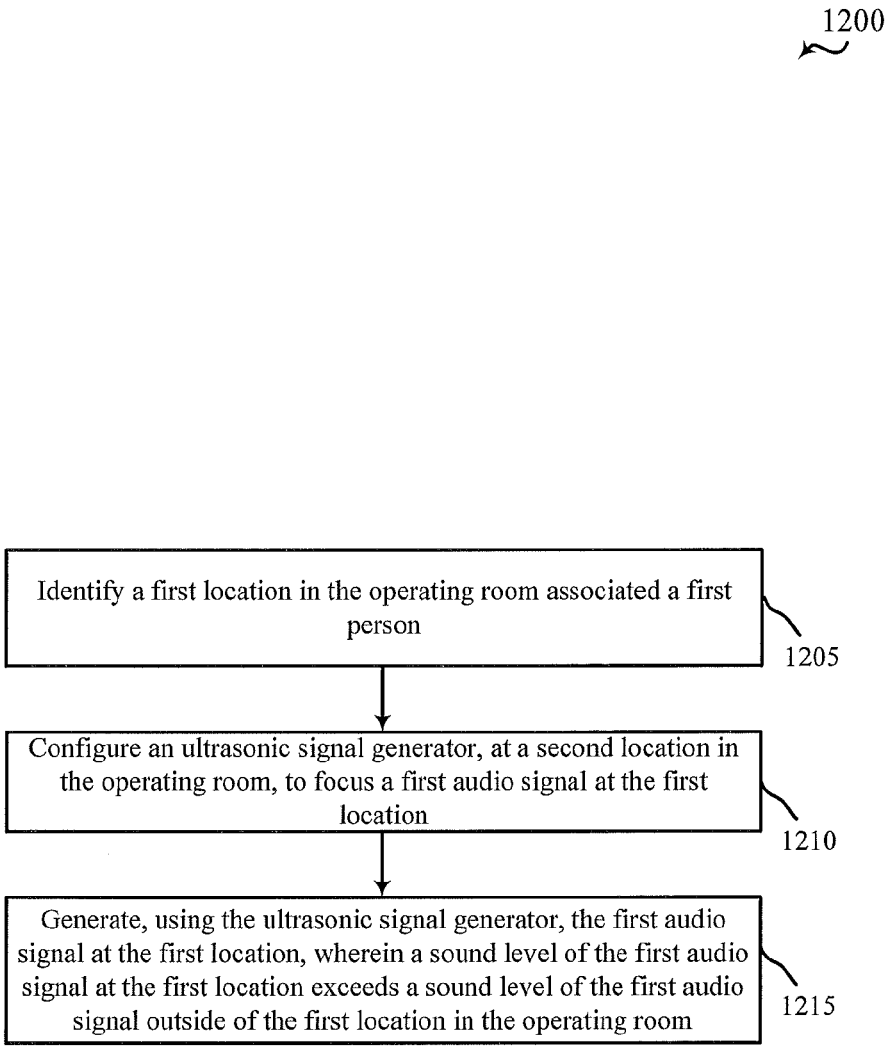
FIG. 12 is a flowchart of an example of operations related to generating an audio signal at a location in an operating room according to various embodiments.

Turning next to FIG. 12, a flow diagram is described for a method 1200 for providing audio to one or more individuals in an operating room in accordance with various embodiments. The method 1200 may be implemented using, for example, audio modules 105 of FIG. 1-3 or 9-11, and/or controller 205 of FIG. 2, for example. Initially, at block 1205, a first location is identified within an operating room that is associated with a first person. Similarly as discussed above, the first location may be a location associated with a particular individual in an operating room, such as a surgeon and/or an anesthesiologist, for example. Such a location may be, for example, an area adjacent an operating table or an anesthesiologist station. The first location may be identified through programming of an audio module or controller with information related to the first location within the operating room, or through a determination made by an audio module or controller that a particular location is the first location. Such a determination may be made, for example, through the identification of a tag or other identifying feature located at or near the first location, or on an individual at the location, and an identification that the particular tag or identifying feature corresponds to a particular audio signal, such as a signal from a particular piece of medical equipment located in the operating room.

At block 1210, an ultrasonic signal generator, at a second location in the operating room, is configured to focus a first audio signal at the first location. Finally, at block 1215, using the ultrasonic signal generator, the first audio signal at the first location is generated, wherein a sound level of the first audio signal at the first location exceeds a sound level of the first audio signal outside of the first location in the operating room. The ultrasonic generators may be part of, for example, an ultrasonic signal generator array that may generate two or more ultrasonic signals that combine at or near the first location to provide an audio signal with the perception that the audio signal emanated from the first location.

Figure 13:
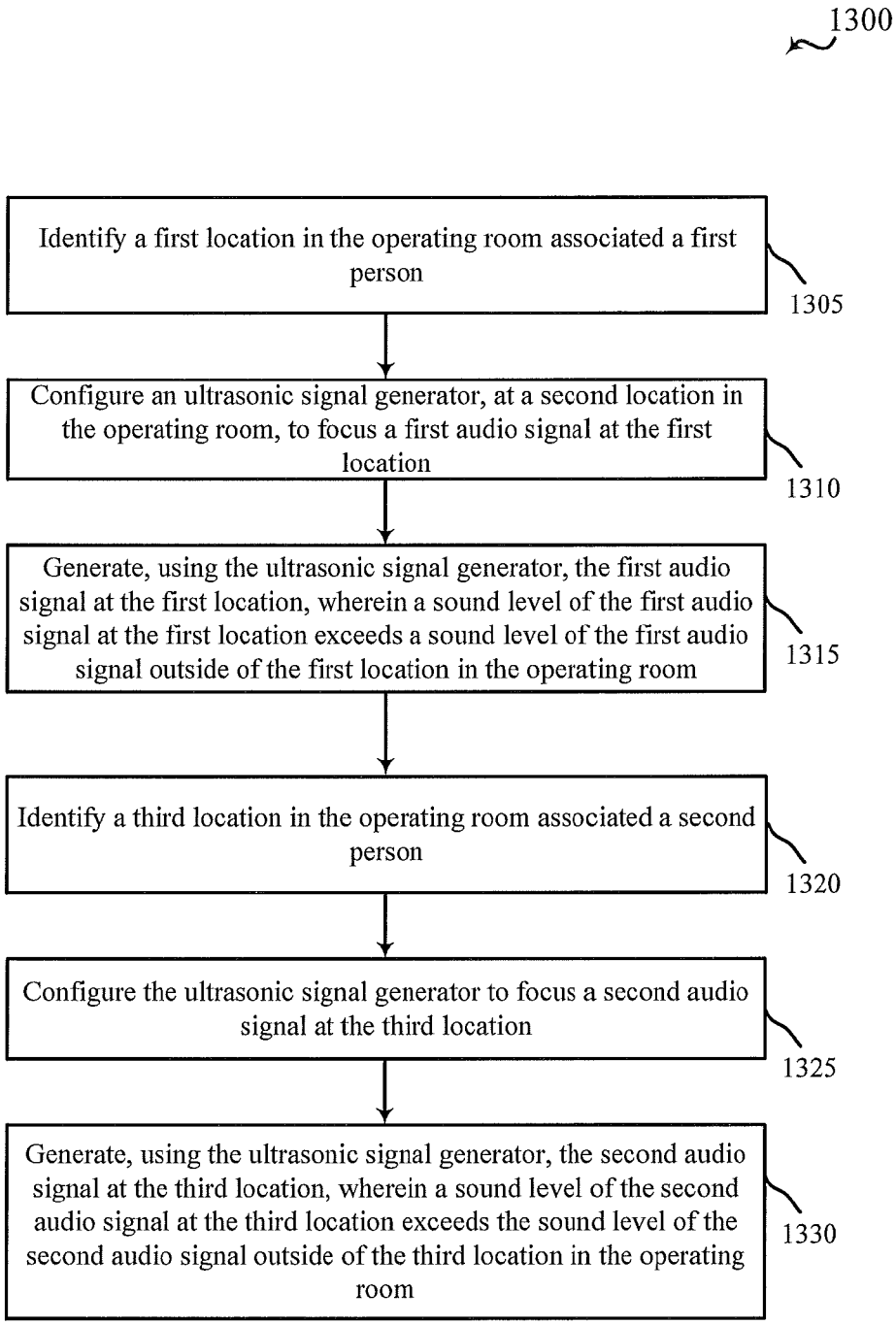
FIG. 13 is another flowchart of an example of operations related to generating an audio signal at a location in an operating room according to various embodiments.

Turning next to FIG. 13, a flow diagram is described for a method 1300 for providing audio to one or more individuals in an operating room in accordance with various embodiments. The method 1300 may be implemented using, for example, audio modules 105 of FIG. 1-3 or 9-11, and/or controller 205 of FIG. 2, for example. At block 1305, a first location is identified within an operating room that is associated with a first person. Similarly as discussed above, the first location may be a location associated with a particular individual in an operating room, such as a surgeon and/or an anesthesiologist for example, which may be determined similarly as discussed above. At block 1310, an ultrasonic signal generator, at a second location in the operating room, is configured to focus a first audio signal at the first location. At block 1315, using the ultrasonic signal generator, the first audio signal at the first location is generated, wherein a sound level of the first audio signal at the first location exceeds a sound level of the first audio signal outside of the first location in the operating room. The ultrasonic generators may be part of, for example, an ultrasonic signal generator array that may generate two or more ultrasonic signals that combine at or near the first location to provide an audio signal with the perception that the audio signal emanated from the first location.

The method 1300 continues, at block 1320, to identify a third location in the operating room associated a second person. Similarly as with the first location, the third location may be a location associated with a particular individual in an operating room, such as a surgeon and/or an anesthesiologist for example, which may be determined similarly as discussed above. The ultrasonic signal generator is configured, at block 1325, to focus a second audio signal at the third location. Finally, at block 1330, using the ultrasonic signal generator, the second audio signal is generated at the third location, wherein a sound level of the second audio signal at the third location exceeds the sound level of the second audio signal outside of the third location in the operating room. Thus, two separate locations in the operating room may receive different audio signals that are localized to the particular location in the operating room.

Figure 14:
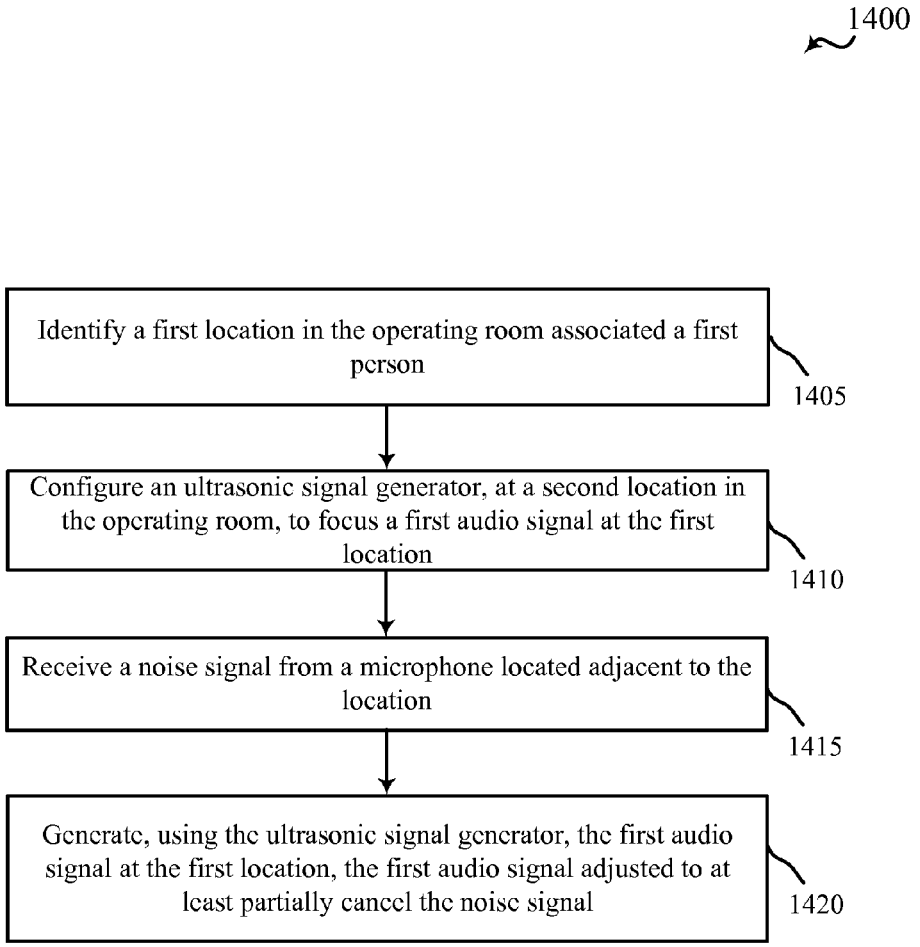
FIG. 14 is another flowchart of an example of operations related to generating an audio signal at a location in an operating room according to various embodiments.

Turning next to FIG. 14, a flow diagram is described for another method 1400 for providing audio to one or more individuals in an operating room in accordance with various embodiments. The method 1400 may be implemented using, for example, audio modules 105 of FIG. 1-3 or 9-11, and/or controller 205 of FIG. 2, for example. Initially, at block 1405, a first location is identified within an operating room that is associated with a first person. Similarly as discussed above, the first location may be a location associated with a particular individual in an operating room, such as a surgeon and/or an anesthesiologist for example, which may be determined similarly as discussed above. At block 1410, an ultrasonic signal generator, at a second location in the operating room, is configured to focus a first audio signal at the first location.

At block 1415, a noise signal is received from a microphone located adjacent to the location. Such a noise signal may be received, for example, from a microphone module that may include a microphone that receives audio from the operating room as a whole, one or more microphones located at different areas of the operating room, or an array of microphones that may be used to localize one or more sources of unwanted audio. Finally, at block 1420, using the ultrasonic signal generator, the first audio signal is generated at the first location, the first audio signal being adjusted to at least partially cancel the noise signal. Thus, unwanted noise from areas outside of a particular location in an operating room may be reduced or canceled, thereby potentially reducing distractions that may arise to individuals within the first location due to such unwanted noise.

As will be readily understood, the components and modules described with reference to various embodiments above may, individually or collectively, be implemented with one or more Application Specific Integrated Circuits (ASICs) adapted to perform some or all of the applicable functions in hardware. Alternatively, the functions may be performed by one or more other processing units (or cores), on one or more integrated circuits. In other embodiments, other types of integrated circuits may be used (e.g., Structured/Platform ASICs, Field Programmable Gate Arrays (FPGAs) and other Semi-Custom ICs), which may be programmed in any manner known in the art. The functions of each unit may also be implemented, in whole or in part, with instructions embodied in a memory, formatted to be executed by one or more general or application-specific processors.

It should be noted that the methods, systems and devices discussed above are intended merely to be examples. It must be stressed that various embodiments may omit, substitute, or add various procedures or components as appropriate. For instance, it should be appreciated that, in alternative embodiments, the methods may be performed in an order different from that described, and that various steps may be added, omitted or combined. Also, features described with respect to certain embodiments may be combined in various other embodiments. Different aspects and elements of the embodiments may be combined in a similar manner. Also, it should be emphasized that technology evolves and, thus, many of the elements are exemplary in nature and should not be interpreted to limit the scope of embodiments of the principles described herein.

Specific details are given in the description to provide a thorough understanding of the embodiments. However, it will be understood by one of ordinary skill in the art that the embodiments may be practiced without these specific details. For example, well-known circuits, processes, algorithms, structures, and techniques have been shown without unnecessary detail in order to avoid obscuring the embodiments.

Also, it is noted that the embodiments may be described as a process which is depicted as a flow diagram or block diagram. Although each may describe the operations as a sequential process, many of the operations can be performed in parallel or concurrently. In addition, the order of the operations may be rearranged. A process may have additional steps not included in the figure.

Furthermore, embodiments may be implemented by hardware, software, firmware, middleware, microcode, hardware description languages, or combinations thereof. When implemented in software, firmware, middleware or microcode, the program code or code segments to perform the necessary tasks may be stored in a computer-readable medium such as a storage medium. Processors may perform the necessary tasks.

Having described several embodiments, it will be recognized by those of skill in the art that various modifications, alternative constructions, and equivalents may be used without departing from the spirit of the principles described herein. For example, the above elements may merely be a component of a larger system, wherein other rules may take precedence over or otherwise modify the application of the principles described herein. Also, a number of steps may be undertaken before, during, or after the above elements are considered. Accordingly, the above description should not be taken as limiting the scope of the invention.

What is claimed is:

1. A method for providing audio to one or more individuals in an operating room, comprising:

identifying a first location within an operating room from which it is desired to have sound emanate; and configuring first and second ultrasonic sound transducers at one or more locations in the operating room different than the first location to focus first and second ultrasonic sounds to the first location, wherein the first and second ultrasonic sounds generate an audible sound substantially at the first location of the operating room, and wherein the first and second ultrasonic sound transducers are configured so that the audible sound is synchronized with at least one information source located in the operation room.

2. The method of claim 1, wherein the information source comprises a surgical device.

3. The method of claim 2, wherein the surgical device comprises a ligature device, and wherein the audible sound provides an indication of when an electrode of the ligature device is activated.

4. The method of claim 2, wherein the surgical device comprises a ligature device, and wherein the first location is located adjacent to an area where the ligature device is being operated.

5. The method of claim 1, wherein the information source comprises a condition monitor for one or more vital statistics of a patient.

6. The method of claim 1, wherein the first location is a video monitor.

7. The method of claim 1, wherein the first location comprises an area proximate to a patient in the operating room.

8. The method of claim 1, wherein sound levels of the audible sound at the first location exceed sound levels of locations adjacent the first location by at least 60%.

9. The method of claim 1, wherein the first location is a surface placed at the first location configured to reflect the audible sound toward one or more persons in the operating room.

10. The method of claim 1, further comprising:

generating the first and second ultrasonic sounds to produce the audible sound substantially at the first location of the operating room.

11. A system for providing audio to one or more individuals in an operating room, comprising:

a first ultrasonic sound transducer located in an operating room and configured to generate a first ultrasonic sound;

a second ultrasonic sound transducer located in the operating room and configured to generate a second ultrasonic sound;

a controller coupled with the first and second ultrasonic sound transducers, the controller comprising a processor and memory in electronic communication with the processor and instructions stored in the memory, the instructions including location information for a first location within the operating room, the instructions operable, when executed by the processor, to cause the controller to direct the first and second ultrasonic sounds at the first location, the first location being different than the location of the first and second ultrasonic sound transducers, wherein the first and second ultrasonic sounds generate an audible sound that appears to emanate from the first location of the operating room, and wherein the controller is further coupled with at least one information source located in the operating room, and the audible sound is synchronized with information output from the information source.

12. The system of claim 11, wherein the information source comprises a surgical device.

13. The system of claim 12, wherein the surgical device comprises a ligature device, and wherein the audible sound provides an indication of when an electrode of the ligature device is activated.

14. The system of claim 12, wherein the surgical device comprises a ligature device, and wherein the first location is located adjacent to an area where the ligature device is being operated.

15. The system of claim 11, wherein the information source comprises a condition monitor for one or more vital statistics of a patient.

16. The system of claim 11, wherein the first location is a video monitor.

17. The system of claim 11, wherein the first location comprises an area proximate to a patient in the operating room.

18. The system of claim 11, wherein the instructions are further operable to cause the controller to identify the first location within the operating room based at least in part on an identification of an optical or radiofrequency tag.

* * * * *